US010184313B2

(12) United States Patent
Cromer

(10) Patent No.: US 10,184,313 B2
(45) Date of Patent: Jan. 22, 2019

(54) PACKER ASSEMBLY WITH WING PROJECTION SLIPS

(71) Applicant: Schlumberger Technology Corporation, Sugar Land, TX (US)

(72) Inventor: Christopher Michael Cromer, Houston, TX (US)

(73) Assignee: SCHLUMBERGER TECHNOLOGY CORPORATION, Sugarland, TX (US)

( * ) Notice: Subject to any disclaimer, the term of this patent is extended or adjusted under 35 U.S.C. 154(b) by 191 days.

(21) Appl. No.: 15/090,220

(22) Filed: Apr. 4, 2016

(65) Prior Publication Data

US 2016/0290095 A1 Oct. 6, 2016

Related U.S. Application Data

(60) Provisional application No. 62/143,495, filed on Apr. 6, 2015.

(51) Int. Cl.
*E21B 23/06* (2006.01)
*E21B 33/129* (2006.01)

(52) U.S. Cl.
CPC ..... *E21B 33/129* (2013.01)

(58) Field of Classification Search
CPC .... E21B 33/129; E21B 33/1291; E21B 23/01; E21B 23/06
USPC ..... 166/138, 140
See application file for complete search history.

(56) References Cited

U.S. PATENT DOCUMENTS 3,643,737 A * 2/1972 Current ..... E21B 23/01 166/139
4,044,826 A * 8/1977 Crowe ..... E21B 23/06 166/120
4,702,313 A * 10/1987 Greenlee ..... E21B 23/01 166/216
4,711,326 A * 12/1987 Baugh ..... E21B 23/01 166/212
5,174,397 A * 12/1992 Currington ..... E21B 23/01 166/138
5,487,427 A * 1/1996 Curington ..... E21B 23/01 166/217
6,431,277 B1 * 8/2002 Cox ..... E21B 23/01 166/117.6
7,424,909 B2 9/2008 Roberts et al.
7,455,118 B2 11/2008 Roberts et al.
7,810,558 B2 10/2010 Shkurti et al.
7,980,300 B2 7/2011 Roberts et al.
8,047,280 B2 11/2011 Tran et al.
9,739,105 B2 * 8/2017 Badrak ..... E21B 23/01

(Continued)

*Primary Examiner* — Kenneth L Thompson

(57) ABSTRACT

A packer with a slip assembly utilizing retainable wing projections. The slip assembly is configured for anchoring the packer in a well upon setting. This setting or deployment of the slip assembly involves shearing of wing projections from the sides of the slips. In this way, the retaining of the wings by counterbore projections of the packer ceases to keep individual slips also retained. That is, the shearing now allows the slips to expand radially into the noted anchoring position. Additionally, utilizing this type of wing shearing for setting allows the wings and indeed, the majority of the slips to be of a composite polymer or other readily millable or otherwise removable material. Thus, following the isolation, a more efficient packer removal may be realized.

19 Claims, 6 Drawing Sheets

(56) References Cited

U.S. PATENT DOCUMENTS

| | | | | |
|---|---|---|---|---|
| 9,752,418 | B2 * | 9/2017 | Meador | E21B 43/10 |
| 2004/0194954 | A1 * | 10/2004 | Cram | E21B 23/04 166/208 |
| 2006/0102361 | A1 * | 5/2006 | Fay | E21B 23/04 166/387 |
| 2008/0190600 | A1 | 8/2008 | Shkurti et al. | |
| 2008/0308266 | A1 | 12/2008 | Roberts et al. | |
| 2010/0326650 | A1 | 12/2010 | Tran et al. | |
| 2015/0021042 | A1 | 1/2015 | Melenyzer et al. | |
| 2015/0159449 | A1 * | 6/2015 | Moyes | E21B 33/134 166/217 |

* cited by examiner

PACKER ASSEMBLY WITH WING PROJECTION SLIPS

CROSS REFERENCE TO RELATED APPLICATION(S)

This Patent Document claims priority under 35 U.S.C. § 119(e) to U.S. Provisional Application Ser. No. 62/143,495, entitled Non-metallic Slips, filed on Apr. 6, 2015, which is incorporated herein by reference in its entirety.

BACKGROUND

Exploring, drilling and completing hydrocarbon and other wells are generally complicated, time consuming, and ultimately very expensive endeavors. As a result, over the years, a significant amount of added emphasis has been placed on well monitoring and maintenance. By the same token, perhaps even more emphasis has been directed at initial well architecture and design. All in all, careful attention to design, monitoring and maintenance may help maximize production and extend well life. Thus, a substantial return on the investment in the completed well may be better ensured.

In the case of well design, architecture and subsequent maintenance, there is often the need to isolate high pressure regions of a cased or lined well with a packer assembly which anchors in place and seals off a region of the well. For example, isolation for the sake of targeted production from a particular region of a well is quite common. However, as well depths continue to become greater and greater, so do well pressures. Thus, the likelihood exists that the well may exceed 20,000 feet in depth, for example, with an architecture targeting an isolated region for production that exceeds 10,000-15,000 PSI. By the same token, a host of interventional applications may also be undertaken which have the effect of introducing such dramatically high pressures in a well. For example, perforations may be formed into the wall of the well at a given location by way of a perforating application which involves isolating the location with a packer assembly. Thus, the packer assembly is subjected to such high pressures introduced by way of the adjacent explosive perforating application.

Faced with such dramatically high pressures, packer assemblies utilize slips to engage and anchor at the wall of the well with a substantial amount of force. For example, the slips may include cast iron teeth which forcibly extended outward into an anchoring biting engagement with the tubular defining the well (i.e. the casing or liner). While generally well suited for anchoring the packer for sake of isolation, the slips may pose a challenge to subsequent applications and interventions. For example, where the packer is utilized for a temporary isolation such as in perforating, there is a subsequent need to remove the packer in advance of production. However, relatively large anchoring slips of cast iron may be a challenge to remove for sake of subsequent production.

A mechanical packer utilizing slips for sake of isolation as described above is generally removed following the isolation application by way of a drill-out or milling application. As noted, this may be a challenge in terms of getting all of the cast iron slip features removed. Indeed, removal of a fully cast iron slip may take well over an hour. Once more, due to the robust nature and high specific gravity of the cast iron material, milling often results in the tool becoming stuck or the material failing to be fully removed. Failure to more fully remove the cast iron material may result in its unintended retrieval during production, potentially harming surface equipment. Potentially even worse though, if the milling tool becomes stuck, all oilfield operations may need to be shut down, followed by time-consuming fishing and/or workover efforts to remediate the situation.

With the above challenges and consequences in mind, efforts have been undertaken to reduce the amount of cast iron or other similarly robust, heavy materials in the slip components of an isolation packer. For example, packers now often reserve the cast iron-type of materials for the teeth or "wicker" portion of the slip while utilizing aluminum for underlying slip components such as the slip ring and base. By way of comparison, an aluminum base material would have a specific gravity of under about 3, whereas cast-iron based materials have a specific gravity that is between about 7 and 8. Therefore, the time required to mill out the plug may be substantially reduced, for example, taking closer to about 30 minutes than say an hour or more which is likely if the slip is fully cast iron. Once more, the odds of the milling tool becoming stuck during the removal application are also dramatically reduced.

With this type of thinking in mind, efforts have also been undertaken to replace underlying aluminum components with even lighter polymer composite materials. That is, while the opportunity may not be available to make the teeth of the slip even lighter due to the casing biting requirements, opportunities to make the underlying components lighter and lighter may be available. Indeed, many slips today incorporate such lighter composite materials with specific gravities below about 2. Thus, milling time for such a plug removal may be even further reduced, for example to perhaps less than about 15 minutes depending on the surrounding circumstances.

Unfortunately, utilizing less structurally robust materials for underlying slip components has its drawbacks. That is, while more readily millable after the isolation application, new challenges may be presented in terms of reliably deploying and anchoring the packer for the isolation application itself. For example, once positioned downhole, the slips are configured to shear away from one another and anchor to a casing as a result of the breaking up of the underlying ring or similar feature. However, when considering that the packer is a large piece of equipment being lowered potentially several thousand feet into a well, there is a strong possibility that a composite polymer ring will prematurely break. When this occurs, the packer may become anchored at the wrong location in the well. Not only is this ineffective for the sought isolation but it will require a separate application run to retrieve the packer and start over. Alternatively, there is also the possibility that the packer does not prematurely begin to set but nevertheless does not uniformly shear as intended, again due to the less robust ring being utilized. In this case, the isolation may be compromised due to a less reliable anchoring. Thus, as a practical matter, operators are often left utilizing the less desirable aluminum or even cast iron components from a milling perspective due to the less reliable composite components from an isolation perspective.

SUMMARY

A packer utilizing a unique slip assembly for anchoring in a well is disclosed. The slip assembly includes a downhole cone with a plurality of spaced apart counterbore projections. Slips are disposed in spaces between the counterbore projections. However, retainable wings emerge from the sides of the slips with each being located below one of the counterbore projections in advance of the anchoring and also having a predetermined shear rating for the anchoring.

DETAILED DESCRIPTION

Embodiments herein are described with reference to certain types of packer assemblies. For example, a mechanical packer is shown which is utilized downhole for a temporary isolation. However, a variety of different types of packer assemblies may take advantage of the unique anchoring embodiments detailed herein. For example, a more permanent packer assembly utilized with production tubing may utilize such anchoring features. So long as the packer includes a slip assembly with counterbore projections utilized to retain shearable wings of slips disposed in spaces between the projections, appreciable benefit may be realized.

Figure 1:
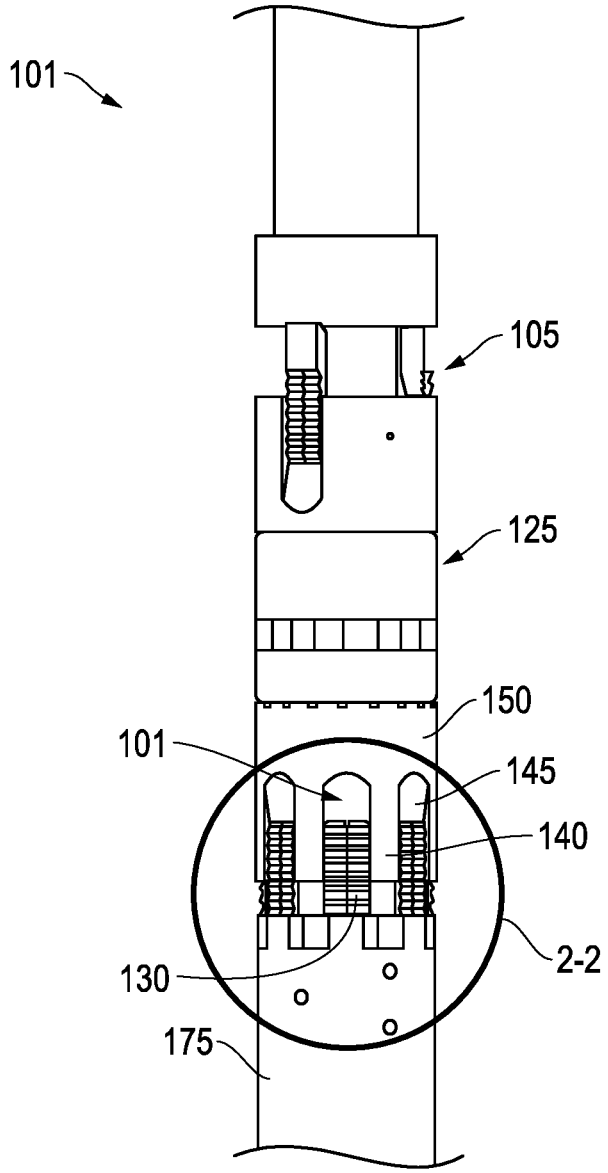
FIG. 1 is a side view of an embodiment of a packer utilizing a slip assembly with winged slips.

Referring now to FIG. 1, a side view of an embodiment of a packer 101 is shown utilizing a slip assembly 100 with winged slips 130. With added reference to FIGS. 2 and 3, the assembly 100 and slips 130 are of a unique architecture. The slips 130 are equipped with wings 200 that interface counterbore projections 140. More specifically, in advance of setting and anchoring of the packer 101, the wings 200 are retained below the counterbore projections 140, thereby substantially maintaining the slips 130 in a retracted position. That is, the interfacing of the wings 200 and projections 140 substantially prevent premature shearing and deployment of the slips 130 which might result in anchoring of the packer 101 in the wrong location downhole (again see FIGS. 2 and 3).

Figure 5A:
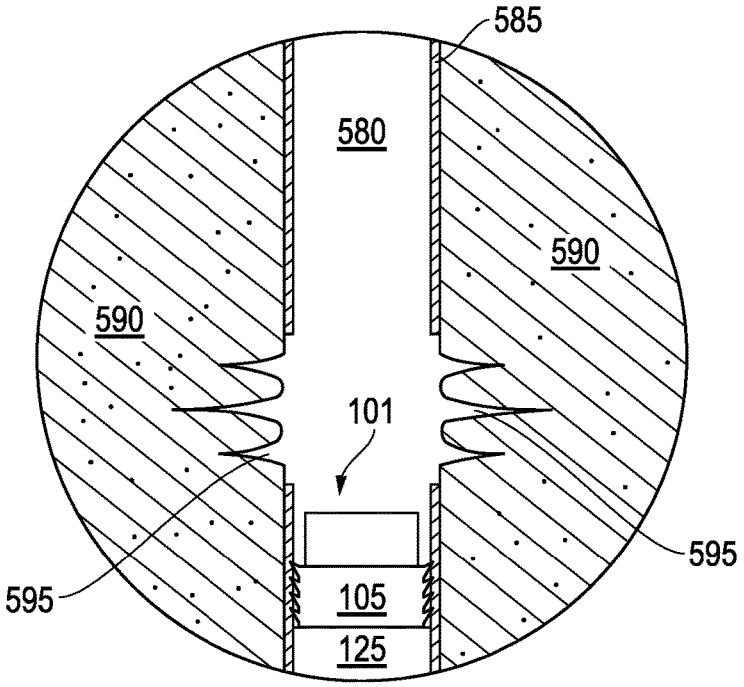
FIG. 5A is an enlarged schematic view of the packer of FIG. 1 anchored in a well by a slip assembly thereof for fluid isolation thereat.

In the embodiment of FIG. 1, the referenced slip assembly 100 is utilized along with another slip assembly 105 to anchor the packer 101 in a well 580 such as depicted in FIG. 5A. Specifically, teeth 300 of a slip 130 are configured to bite into casing 585 to immobilize the packer 101, for example to fluidly isolate a region of the well 580 thereabove (see FIGS. 3 and 5A). That is, while the slip assemblies 100, 105 anchor the packer 101 in place, a seal element 125 may compressibly, inflatably or otherwise fluidly seal the well 580 at the noted location (again see FIG. 5A).

As with other conventional mechanical packers or bridge plugs, the packer 101 of FIG. 1 is equipped with a lower cone 150 that accommodates the slips 130 with an incline surface 145 to promote radial expansion into a deployed state during setting. Specifically, a subassembly 175 below the slips 130 and the cone 150 may be contracted toward one another by a setting module of the packer 101 or other suitable mechanism, as directed from an oilfield surface.

Figure 2:
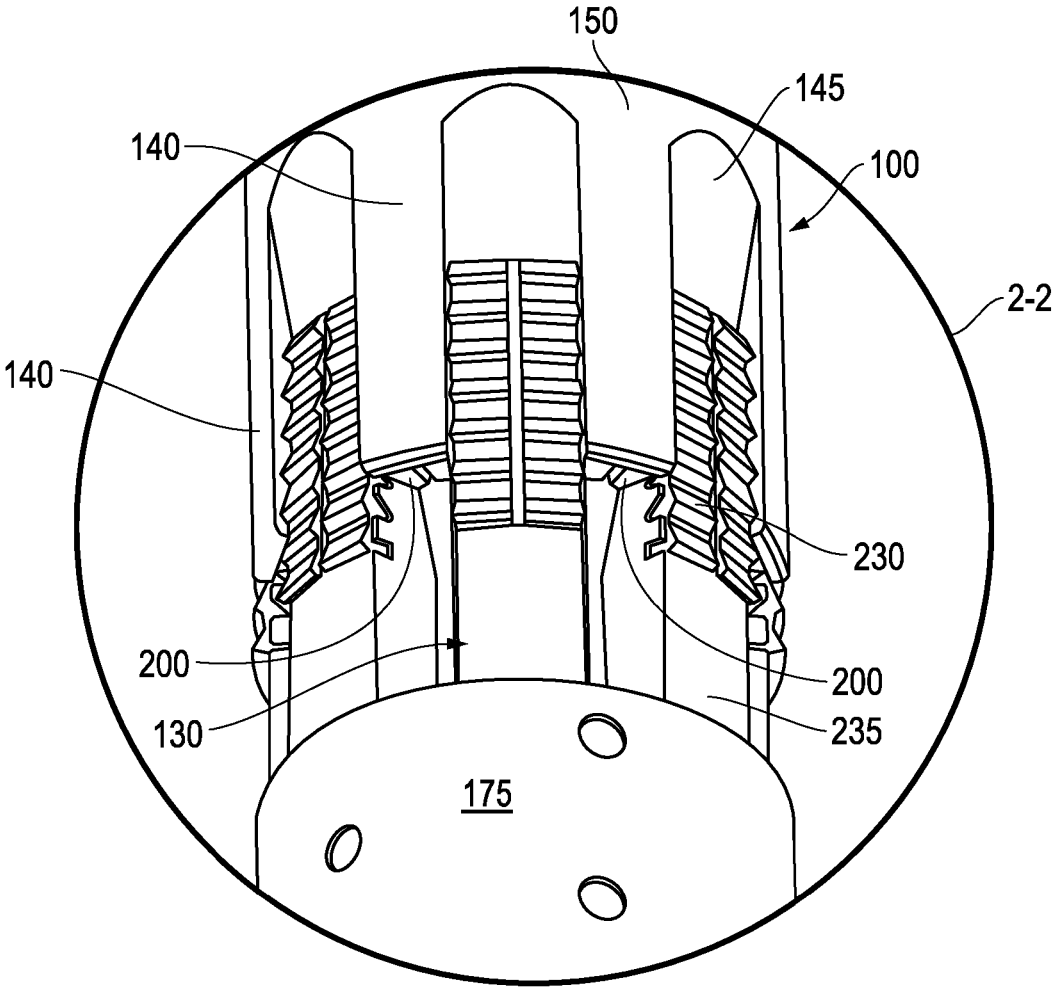
FIG. 2 is an enlarged perspective view of a slip assembly taken from 2-2 of FIG. 1 and revealing interfacing slip wings and counterbore projections.

Referring now to FIG. 2, an enlarged perspective view of a slip assembly 100 is shown that is taken from 2-2 of FIG. 1. In this view, the interfacing of the slip wings 200 and the counterbore projections 140 of the cone 150 are more apparent. Specifically, with added reference to FIG. 1, the assembly 100 is shown as part of the packer 101 prior to setting in a well 580 such as that depicted in FIGS. 5A and 5B. This may include a variety of times after packer assembly. However, most notably it may include a time period in which the packer 101 is to be deployed from a more secure, operator-controlled environment and advanced through a well 580 (again see FIGS. 5A and 5B). Indeed, in a typical well environment of today, this may include advancing the packer 101 tens of thousands of feet downhole without any direct control over its physical surroundings. Stated another way, there is a high probability of a substantial amount of impacts and other stressors being imparted on the assembly 100 as the packer 101 randomly bounces off of well casing 585 and other features on its way to its targeted destination (see FIGS. 5A and 5B).

Figure 5B:
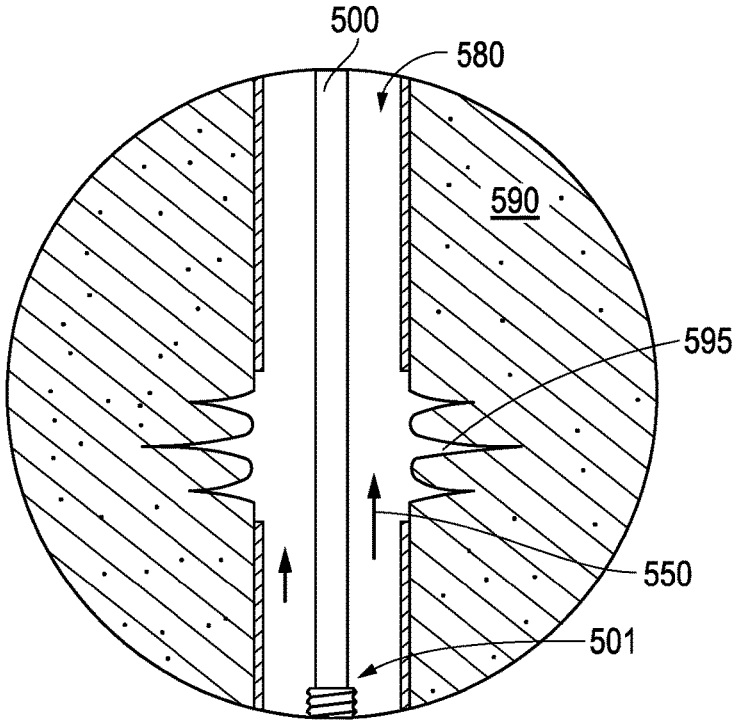
FIG. 5B is an enlarged schematic view of a milling application being applied to the isolation packer of FIG. 5A.

In spite of the conventional stressors imparted on the slip assembly 100, it is of a unique architecture so as to substantially prevent premature deployment or "anchoring" of the slips 130 during advancement through a well 580 as shown in FIGS. 5A and 5B. Specifically, deployment of each slip 130 is governed by shearing of wings 200 which extend from the sides of each slip 130. More particularly, the wings 200 emerge from a slip base 235 of each slip 130. However, the wings 200 extend to a location where they are securely positioned below the counterbore projections 140 of the cone 150. Thus, the mode of slip anchoring, the shearing of the wings 200, is shielded from direct well exposure during deployment of the packer 101 through the well 580 (see FIGS. 5A and 5B).

In one embodiment, with added reference to FIG. 2, adjacent wings 200 of adjacent slips 130 are actually connected to one another such that the assembly 100 is configured as a continuous ring of supportive structure. In this embodiment, shearing of the wings 200 includes shearing apart adjacent wings 200 in addition to shearing each wing 200 away from its corresponding slip base 235. With this added measure of shearing required for setting, a wider range of setting force, or "slip release force" options may be available for attaining anchoring.

With the above-described architecture in mind, it is apparent that the shearing of the wings 200 is less likely to take place accidentally and instead may be more controllably directed through an intended setting mechanism for the packer 101. This may include use of a hydrostatic set module or other similar setting device, perhaps incorporated into the subassembly 175, the cone 150 or at another suitable location.

With added reference to FIG. 5A, as alluded to above, once a setting device of the subassembly 175, or other packer location, is actuated it may forcibly draw the cone 150 and subassembly 175 toward one another. Thus, each slip 130 is in turn forced up an incline surface 145 of the cone 150, each wing 200 will eventually shear at a predetermined amount of force, thereby releasing each slip 130 into biting engagement with casing 585. Specifically, a teethed wicker 230 of each slip 130 may be brought into such biting engagement. For example, the wings 200 may be configured to shear at about 10,000 lbs. of force and the setting device may impart a sudden application of about 12,500 lbs. to ensure a substantially simultaneous shearing of all wings 200 for a uniform setting of the packer 101.

Figure 3:
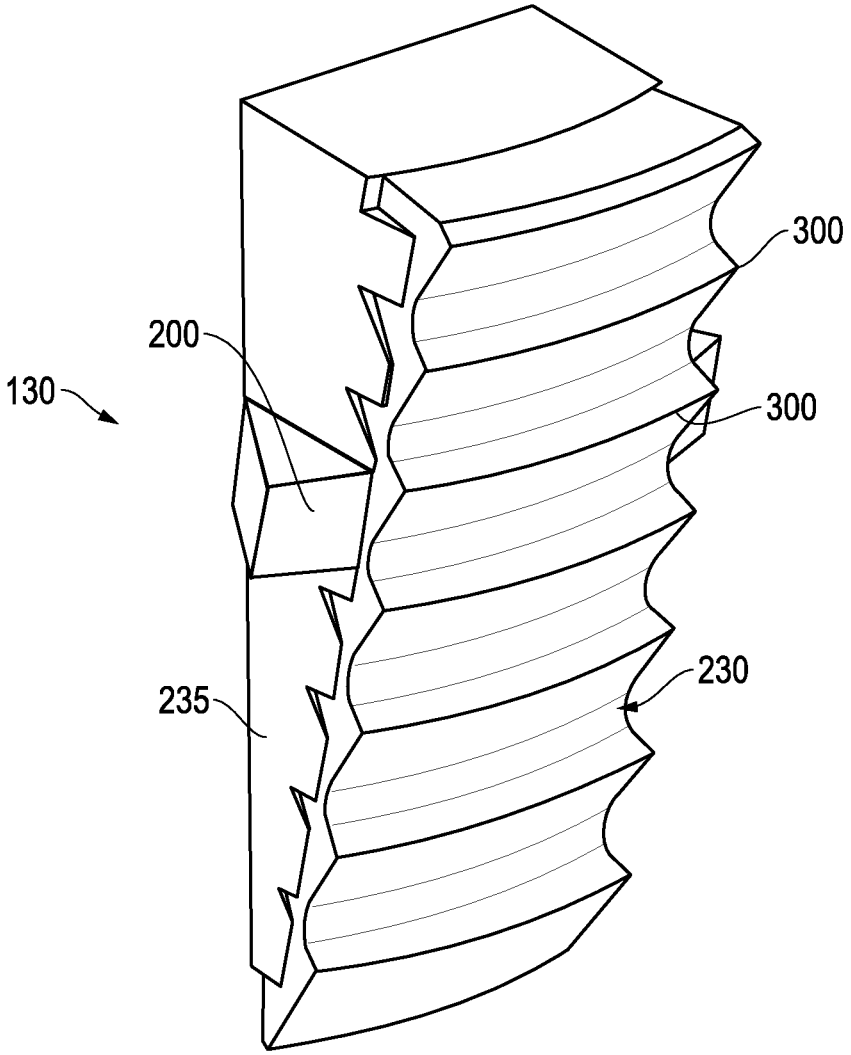
FIG. 3 is a side perspective view of a winged slip of the assembly of FIG. 2.

Referring now to FIG. 3, a side perspective view of a winged slip 130 of the assembly 100 of FIG. 2 is shown. In this view, the individual teeth 300 of the wicker 230 are apparent. These teeth 300 and the body of the wicker 230 directly interface the casing 585 during setting of the packer 101 as shown in FIG. 5A. Thus, the teeth 300 and wicker 230 may be of a cast iron or other suitably durable material of sufficient hardness to achieve such biting into the casing 585 during packer anchoring. For example, in one embodiment, the teeth 300 may be induction hardened.

However, it is also apparent in the embodiment shown that the remainder of the slip 130 may be of other, more millable materials. For example, the base 235 and wings 200 may be of a single molded polymer based composite. In one embodiment, the composite may include glass particles or a variety of other manufacturing and/or performance additives incorporated therein. Regardless, the specific gravity of the base 130 and wings 200 may remain below about 3. Furthermore, even though of a substantially greater specific gravity, the wicker 230 and teeth 300 may be comparatively thinner, constituting a minority of the overall volume of the slip 130. Thus, during milling, the majority of the slip 130, the underlying base 235 and wings 200, may be readily removed without undue time required to produce the materials thereof.

Figure 4:
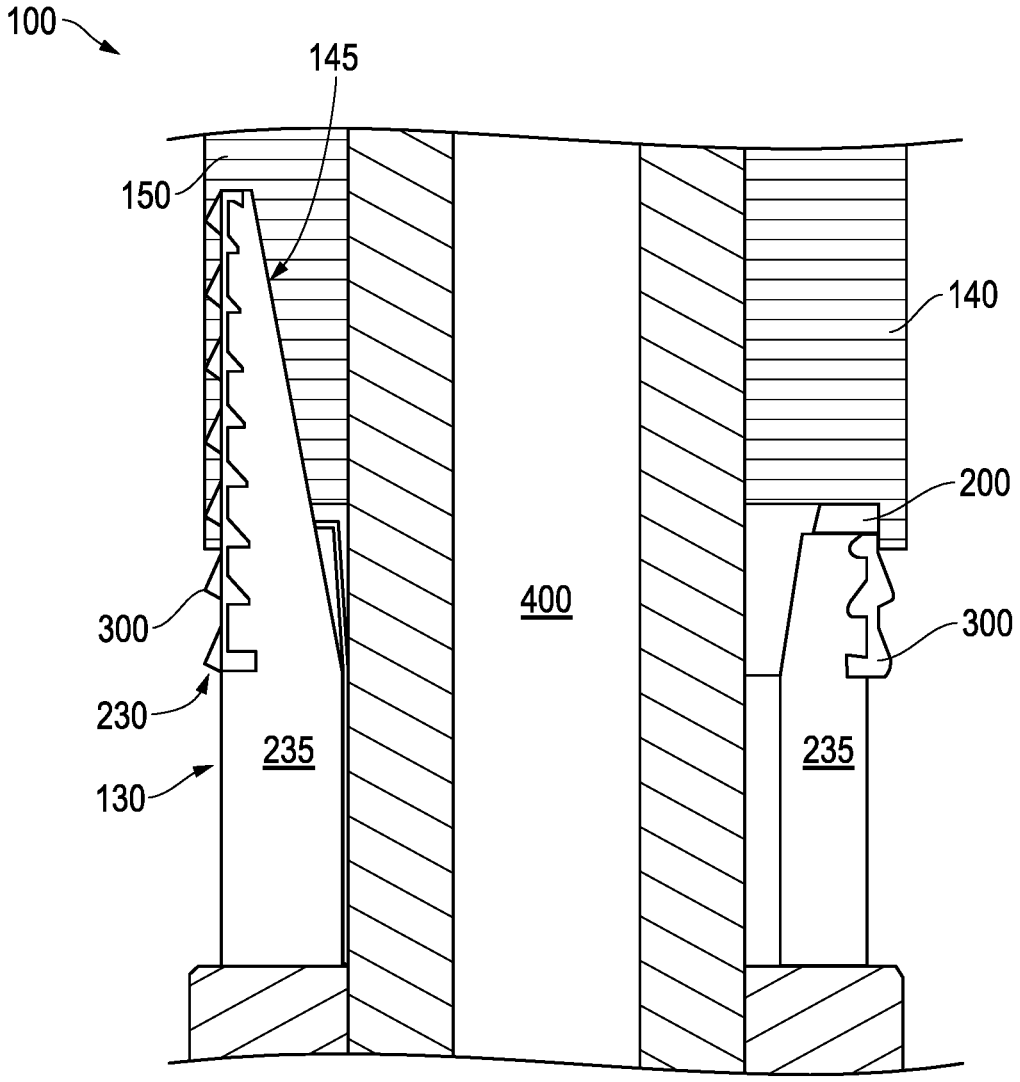
FIG. 4 is a cross-sectional perspective view of the slip assembly of FIG. 2.

Referring now to FIG. 4, a cross-sectional perspective view of the slip assembly 100 of FIG. 2 is shown. In this view, a central mandrel 400 is apparent about which the slips 130 are disposed. The packer 101 is not yet set (see FIG. 1). Thus, in this particular cross-section, the positioning of wings 200 below counterbore projections 140 of the cone 150 is visible. However, as the cone 150 and subassembly 175 of FIG. 2 are suddenly brought closer together during setting, it is apparent that each slip 130 would slide along an incline surface 145, shear the wings 200 and radially extend away from the mandrel 400 for anchoring. For example, note the anchored packer 101 of FIG. 5A in this regard.

Continuing with reference to FIG. 4, the profile of the slips 130 in particular are also of note. For example, as indicated above, the teeth 300 and wicker 230 appear to constitute a small minority of the overall body of each slip 130. Thus, in an embodiment where the base 235 and wings 200 are of a lightweight polymer composite, it is readily apparent that the large majority of each slip 130 is efficiently millable. Indeed, with only a thin, small minority of each slip 130 being of cast iron or other similarly durable material, the entirety of each slip 130 is not only efficiently millable or drillable, but also less prone to cause a milling or drilling tool to become stuck during such an application (see FIG. 5B).

Referring now to FIG. 5A, an enlarged schematic view of the packer 101 of FIG. 1 is shown anchored in a well 580 by a slip assembly 105 thereof for fluid isolation. Specifically, the packer 101 is set with teeth 300 of the assembly 105 achieving a secure biting engagement into a metal casing 585 which defines the well 580 (see FIG. 4). In addition to this anchoring engagement, the packer 101 has also achieved a sealing engagement with the casing 585 through a seal element 125 which has been compressibly or otherwise expanded into the depicted engagement shown.

With a reliable fluid isolation achieved by way of the packer 101, an application directed at a region above (or below) the packer 101 may ensue. For example, in the embodiment shown, the well 580 traverses an underground formation 590 and includes perforations 595. The perforations extend from the main bore of the well 580 into the formation 590. Thus, they may promote the uptake of hydrocarbon fluids from the formation 590 through the well 580. Further, the fluid isolation provided by the packer 101 may support an application directed at these perforations 595. This may include a fluidly isolated stimulation application directed at the perforations 595 to enhance the productiveness of the perforations. Of course, following such an application, there may be a desire to remove the packer 101 to achieve production or otherwise provide access to areas therebelow.

Referring now to FIG. 5B, an enlarged schematic view of a milling application being applied to the isolation packer 101 of FIG. 5A is shown. Specifically, a milling tool 501 supported by coiled tubing 500 is driven through the region occupied by the packer 101. Due to the minimal use of cast iron in the overall packer 101, it may be efficiently removed, perhaps in less than about 15 minutes, and without undue risk of becoming stuck during the removal process. Materials of the packer 101, including the entirety of the slip assembly 105, may be flowed to surface during, and immediately following, the milling application (see arrows 550). Thus, access to regions below the packer 101 may now be reached and/or production therefrom as well as through the perforations 595.

Figure 6:
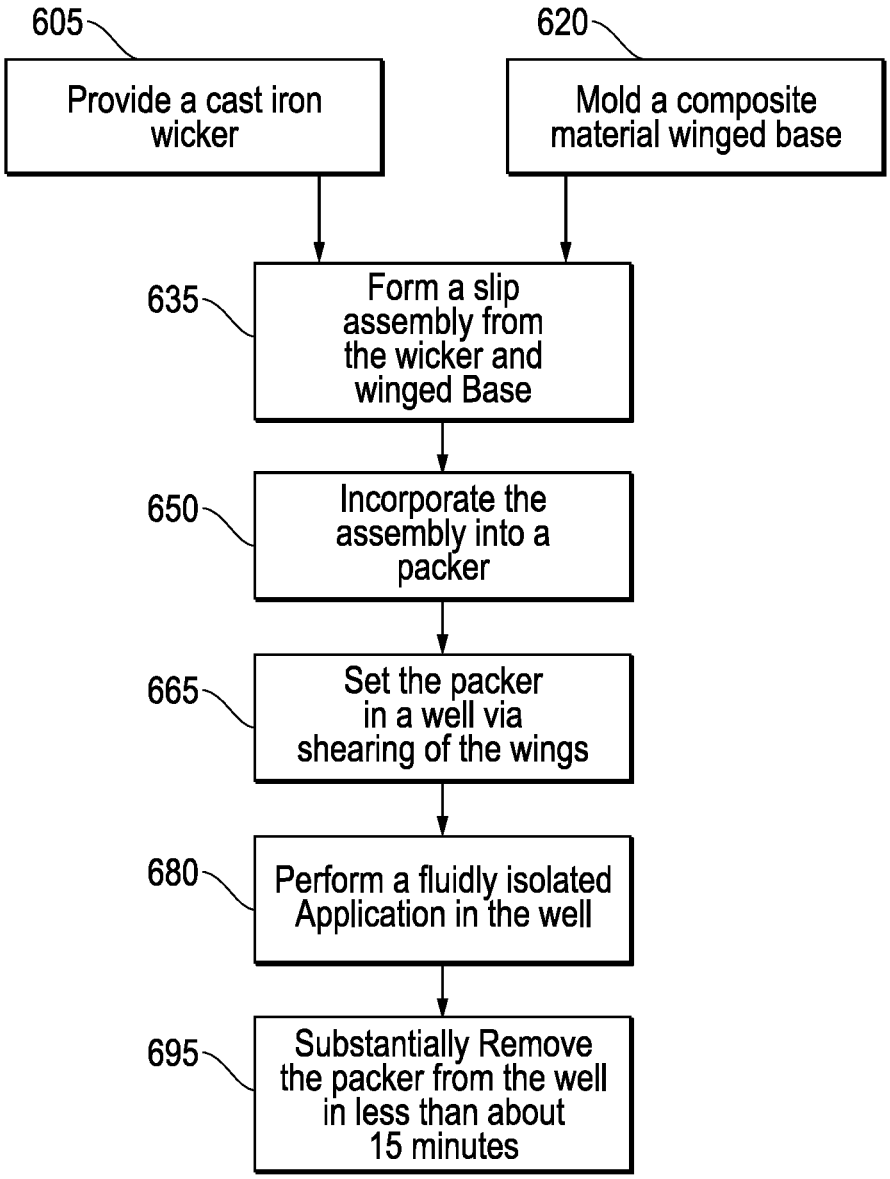
FIG. 6 is a flow-chart summarizing an embodiment of utilizing a slip assembly with winged slips in a well.

Referring now to FIG. 6, a flow-chart is shown summarizing an embodiment of assembling and utilizing a slip assembly with winged slips in a well. The slip assembly may be formed from a cast iron or other suitably durable wicker with teeth, buttons or other protrusions for biting into a casing in combination with a winged base (see 605, 620 and 635). Of course, as indicated above, advantages to such a configuration may include the ability to use a thin wicker while the majority of each slip is made up of a lighter weight composite for efficient removal (see 695).

As also indicated above, the configuration of the assembly also provides advantages in the controlled nature of the winged shearing for setting of the packer and the options available for slip release forces which may be reliably employed. That is, even for a more permanent packer without significant concern over material choice for sake of later removal, such slip assembly configurations may be desirable. Regardless, once assembled, the slip assembly may be incorporated into the packer as indicated at 650 and advanced through a well to a target location for fluid isolation.

Once positioned at the target location, the packer may be set through the unique manner of wing shearing described above and a fluidly isolated application run in the well (see 665 and 680). In embodiments where the majority of the slips are made up of underlying composite and the packer includes no substantial features with a specific gravity exceeding that of the wickers, the entire packer may be removed in less than about 15 minutes as indicated at 695.

Embodiments described hereinabove provide a slip assembly that is able to utilize more readily millable composite materials without substantial compromise to shearing and anchoring reliability to the associated packer. That is, the packer utilizing such a slip assembly may reliably and more uniformly deploy when triggered to do so because of separate wing and projection components. In this way, the shearing and deploying of the slips are not solely reliant upon underlying, less reliable composite materials. Nevertheless, such materials may be utilized for the underlying components so as to promote efficient post-isolation removal.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

What is claimed is:

1. A slip assembly for interfacing a wall of a well to anchor a fluid isolating packer therein, the slip assembly comprising:

a downhole cone with a plurality of spaced apart counterbore projections;

a plurality of slips disposed in spaces between the counterbore projections; and a plurality of retainable wings coupled to the slips at sides thereof, each wing disposed below one of the counterbore projections in advance of the anchoring and of a predetermined shear rating for the anchoring.

2. The assembly of claim 1 wherein adjacent wings of adjacent slips of the pluralities are coupled to one another in advance of the anchoring.

3. The assembly of claim 1 wherein each slip comprises:

a slip base;

at least one wing of the plurality thereof coupled to the slip base;

a wicker over the base and wing for the interfacing of the well wall during the anchoring.

4. The assembly of claim 3 wherein the wicker further comprises teeth to promote the anchoring.

5. The assembly of claim 3 wherein the wicker is of a material having a specific gravity substantially greater than that of the slip base and the wing.

6. The assembly of claim 5 wherein the wicker comprises a minority of the volume of the slip.

7. The assembly of claim 5 wherein the wicker is of a material selected from a group consisting of a cast iron based material and an induction hardened material.

8. The assembly of claim 5 wherein the slip base and the wing are of a polymer composite based material having a specific gravity below about 3.

9. The assembly of claim 8 wherein the polymer composite based material further comprises glass particles incorporated therein.

10. A packer for positioning at a location in a well, the packer comprising:

first and second slip assemblies for anchoring the packer at the location;

an element of the packer between the slip assemblies for fluidly isolating the well at the location, at least one of the slip assemblies further comprising a cone with a counterbore projection for retaining a wing of a slip thereof in advance of the anchoring, the wing of a predetermined shear rating for deploying the slip for the anchoring.

11. The packer of claim 10 configured as a removable bridge plug.

12. The packer of claim 10 wherein the cone comprises an incline surface for promoting the deploying of the slip for the anchoring upon shearing of the wing.

13. The packer of claim 12 further comprising a subassembly at an opposite side of the slip assembly from the cone, the shearing of the wing effected by compressing together of the subassembly and the cone.

14. The packer of claim 13 further comprising a setting device to initiate the compressing.

15. The packer of claim 14 wherein the setting device is a hydrostatic set module of the subassembly.

16. A method of using a packer comprising first and second slip assemblies at a location in a well, at least one of the slip assemblies comprising a cone with a counterbore projection, the method comprising:

retaining a wing of a slip below the counterbore projection of the packer;

shearing the wing to release the slip into anchoring interface with a casing defining the well, the wing of a predetermined shear rating for deploying the slip for the anchoring; and fluidly isolating the well at the location in the well via an element of the packer between the slip assemblies.

17. The method of claim 16 further comprising:

providing a cast iron wicker with teeth to support the anchoring; and molding a polymer composite material onto the wicker to form the wing and a base below the wicker, the wing, base and wicker comprising the slip.

18. The method of claim 17 wherein a substantial majority of the slip is made up of the polymer composite material by volume.

19. The method of claim 18 further comprising performing one of a milling application and a drilling application to substantially remove the packer from the well in less than about 15 minutes.

* * * * *